US010961733B2

(12) United States Patent
Robinson

(10) Patent No.: US 10,961,733 B2
(45) Date of Patent: Mar. 30, 2021

(54) EXPANSION FORMS AND ASSOCIATED TECHNIQUES FOR REPAIRING CONCRETE DAMAGE

(71) Applicant: Glenn Robinson, Camden, AL (US)

(72) Inventor: Glenn Robinson, Camden, AL (US)

( * ) Notice: Subject to any disclaimer, the term of this patent is extended or adjusted under 35 U.S.C. 154(b) by 0 days.

(21) Appl. No.: 16/717,529

(22) Filed: Dec. 17, 2019

(65) Prior Publication Data

US 2020/0123795 A1 Apr. 23, 2020

Related U.S. Application Data

(63) Continuation-in-part of application No. 16/444,940, filed on Jun. 18, 2019, now Pat. No. 10,577,760.

(60) Provisional application No. 62/689,054, filed on Jun. 22, 2018.

(51) Int. Cl.
*E04G 23/02* (2006.01)
*E04B 1/66* (2006.01)

(52) U.S. Cl.
CPC ..... *E04G 23/0203* (2013.01); *E04B 1/66* (2013.01)

(58) Field of Classification Search
CPC ..... E04G 23/0203; E04B 1/66; E04B 1/68; E04B 1/6812; E01C 23/0973; E01C 23/16; E01C 23/06; E01C 11/04; E01C 11/106; E01D 19/06
See application file for complete search history.

(56) References Cited

U.S. PATENT DOCUMENTS 1,329,631 A * 2/1920 Riehle ..... E01C 11/106 404/65
RE15,840 E * 5/1924 Riehle ..... E01C 11/106 404/65
1,503,942 A * 8/1924 Fischer ..... E01C 11/106 404/65
2,539,875 A * 1/1951 Van London ..... E01C 11/106 404/74
3,276,334 A * 10/1966 Rhodes ..... E01C 11/126 404/74
3,330,187 A * 7/1967 Kohler ..... E01C 11/10 404/65
3,334,557 A * 8/1967 Fitzgibbon ..... E01C 11/103 404/64
4,023,324 A * 5/1977 Majeske ..... E01C 11/10 52/396.02
4,285,612 A * 8/1981 Betti ..... E01C 11/04 14/73.1

(Continued)

*Primary Examiner* — Abigail A Risic
(74) *Attorney, Agent, or Firm* — Mehrman Law Office; Michael J. Mehrman

(57) ABSTRACT

The bottom of an expansion form is carved to approximately match the contour of the bottom of a crack or joint, while the top is allowed to "run wild" above the surface level. A generous bead of flexible caulk is applied to the bottom of the crack or joint and the expansion form is gently pressed into the caulk to seal the bottom of the expansion form to the bottom of the crack or joint. The damaged area is backfilled and graded, and the top of the form is trimmed after backfill sets. The lower portion of the expansion form is made from a closed-cell polyethylene foam board with sawed sides, which opens the cells to improve the adhesion of the expansion form to the backfill material. Lateral blocking may be used to support the expansion form upright and following the joint or crack while the backfill sets.

14 Claims, 9 Drawing Sheets

(56) References Cited

U.S. PATENT DOCUMENTS

| | | | | |
|---|---|---|---|---|
| 5,190,395 | A | 3/1993 | Cathey et al. | |
| 5,686,174 | A * | 11/1997 | Irrgeher | E04B 1/6812 428/304.4 |
| 6,074,128 | A * | 6/2000 | Marino | C08L 95/005 404/75 |
| 6,183,575 | B1 | 2/2001 | Embeltom | |
| 8,813,450 | B1 | 8/2014 | Hensley et al. | |
| 9,719,248 | B1 | 8/2017 | Meacham | |
| 9,822,499 | B2 * | 11/2017 | Yan | C04B 18/141 |
| 2005/0036834 | A1 | 2/2005 | Shaw et al. | |
| 2010/0307102 | A1 | 12/2010 | Barnett et al. | |
| 2018/0163349 | A1 * | 6/2018 | Danna | B29C 48/00 |
| 2018/0163393 | A1 * | 6/2018 | Danna | E01C 11/106 |

* cited by examiner

EXPANSION FORMS AND ASSOCIATED TECHNIQUES FOR REPAIRING CONCRETE DAMAGE

REFERENCE TO RELATED APPLICATION

This application is a continuation-in-part claiming priority to U.S. patent application Ser. No. 16/444,940 filed Jun. 18, 2019, which claims priority to U.S. Provisional Patent Application Ser. No. 62/689,054 filed Jun. 22, 2018, which are both incorporated by reference.

TECHNICAL FIELD

The present invention is directed to techniques for repairing concrete and failed concrete repairs and, more particularly, to expansion forms and associated techniques suitable for repairing heavy duty concrete decks, such as those at airports, military bases, loading docks, concrete roadways, and the like.

BACKGROUND

Concrete decks typically include a series of concrete sections or slabs separated by expansion or construction joints. The joints allow the adjacent deck sections to move a small amount with respect to each other to reduce cracking caused by concrete curing, settling, thermal expansion, vibration, load flex, wind load, moisture changes, and other types of movement. Nevertheless, normal wear and tear including heavy loads, thermal cycles and other stresses expose the deck sections to spalling concrete loss at cracks and joints, eventually causing larger spalled areas or potholes. Occasional maintenance is therefore required to repair and stop the progression of the damage.

Repairing concrete damage at an expansion or construction joint is complicated because simply filling the joint with a rigid concrete repair material is inadvisable. This is because filling the joint with a rigid concrete repair material effectively defeats the purpose of the joint, causing the repair material and surrounding concrete to crack and spall quickly due to relative movement of the adjacent slabs. Conventional approaches to preserving the joint while repairing the damage typically involves a two-stage repair technique that requires closing the damaged area for an extended period. For example, the prevailing concrete deck repair technique uses forms temporarily placed along each slab of the joint, which are backfilled with concrete repair material. The forms are then removed with the aid of a bond breaker and the patch is allowed to cure overnight. The repair crew returns the next day (weather permitting) to clean the bond breaker from the repaired surfaces and install a neoprene, silicone rubber, or silicone rubber caulk seal into the joint to prevent water, sand and other debris from infiltrating the joint. The repair process requires closing the damaged area for an extended period, which can be extremely disruptive to the traffic. In some cases, the repair crew may have to repair each side of the joint on separate days, which further extends the repair process.

Meandering cracks occurring away from expansion or construction joints can be even more difficult to repair because there are no slab nosings to repair, and no joints to rebuild. The conventional repair technique involves filling the meandering crack and associated spalled damage with a rigid concrete repair material, such as polymer concrete. Pieces of steel rebar or wire may be buried within the concrete repair material to strengthen the patch. This type of repair can quickly crack and spall again due the same forces that created the crack in the first place. There is, therefore, a need for improved techniques for repairing concrete damage and failed concrete repairs.

SUMMARY

The present invention meets the needs described above through concrete repair techniques using expansion forms that include a polymeric closed cell foam material, such as polyethylene foam. The polymeric closed cell foam material is sufficiently soft to be carved with hand tools at the repair site. This allows the bottom of the expansion form to be carved to approximately match the contour of the bottom of the crack or joint, while the top of the expansion form is allowed to "run wild" above the surface level. A generous bead of flexible caulk is applied to the bottom of the crack or joint, The bottom of the expansion form is gently pressed into the caulk to create a seal between the bottom of the expansion form and the bottom of the crack or joint. The damaged area is then backfilled with a concrete repair material and graded to the surface level. All or the lower portion of the expansion form is made from a closed-cell polymeric foam board with sawed lateral sides, which opens the cells along the lateral sides to improve the adhesion of the expansion form to the backfill material. Lateral blocking may be used to support the expansion form while the damaged area is backfilled and allowed to set.

It will be understood that specific embodiments may include a variety of features in different combinations, as desired by different users. The specific techniques and systems for implementing particular embodiments of the invention and accomplishing the associated advantages will become apparent from the following detailed description of the embodiments and the appended drawings and claims.

BRIEF DESCRIPTION OF THE FIGURES

The numerous advantages of the embodiments of the invention may be better understood with reference to the accompanying figures.

DETAILED DESCRIPTION

Figure 1A:
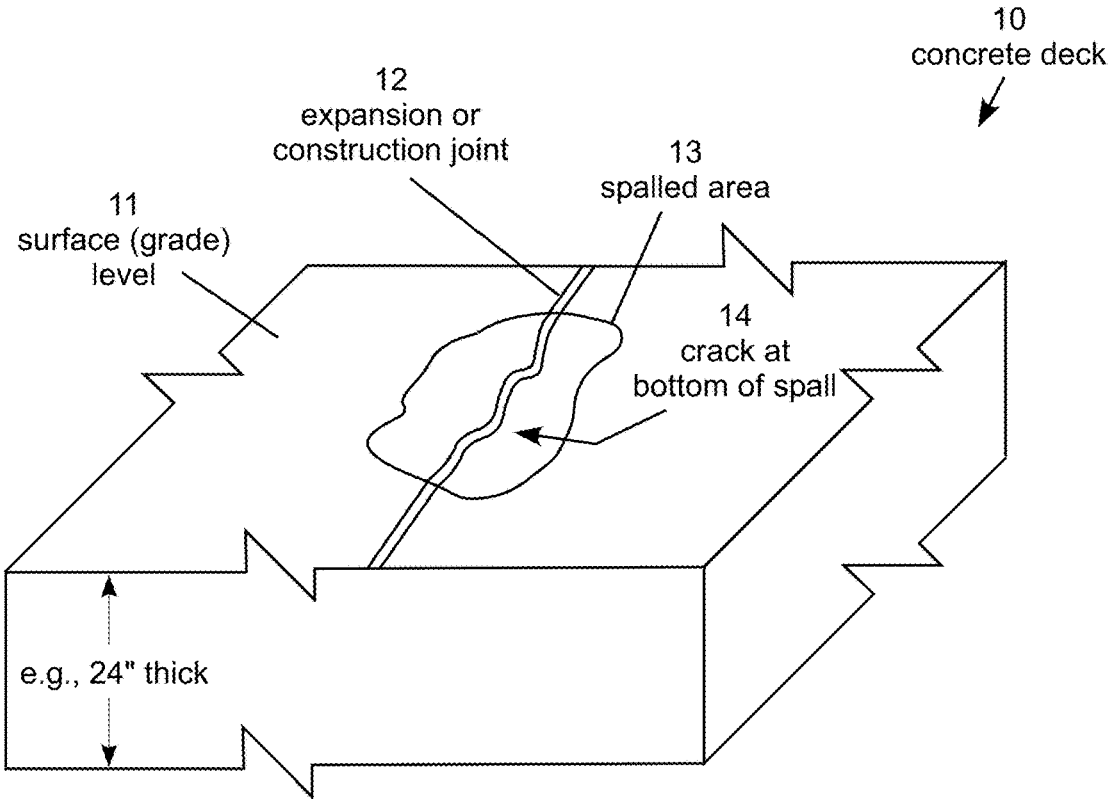
FIG. 1A is a perspective view of spalled concrete damage at a joint in a representative concrete deck.

Since the introduction of modern general purpose polymer concretes (e.g., RESURF®LR and RESURF®II), concrete deck failures at expansion and construction joints have been repaired in a multi-visit process requiring a road closure over at least two site visits on at least two different days. This requires extended road closures and associated disruption. Embodiments of the invention revolutionize concrete joint and meandering crack repair into a single-visit process reducing the closure to a single event of two to three hours. U.S. patent application Ser. No. 16/444,940, which is incorporated by reference, describes techniques for repairing concrete damage at spalled joints in concrete decks, such as roads, bridges, culverts and the like. The present disclosure describes additional techniques for repairing concrete damage occurring at concrete joints and meandering cracks that occur away from joints. While these concrete repair techniques are not dependent on the thickness of the concrete to be repaired, they are well suited for repairing damage typically found in thicker, heavy duty concrete slabs designed to support heavier loads, such as those at airports, military bases, loading docks, concrete roadways, and the like.

Conventional concrete repair techniques utilize inflexible materials, such as polymer concrete or other conventional backfill materials, to backfill cracks and spalled areas. These backfill materials do not expand and contract sufficiently in response to expansion and contraction of the concrete slabs resulting in rapid cracking and spalling of the backfill material and continued damage to the surrounding concrete. To address this problem, the innovative concrete repair techniques utilize one or more "expansion forms" (sometimes referred to as "joint forms") backfilled with polymer concrete or another suitable backfill material. The expansion form has the ability to expand and contract to minimize cracking of the concrete slabs and backfill materials. In some cases, the expansion form may itself crack or separate from the backfill material instead of the concrete slab or backfill material, which is preferable to having the concrete slab or backfill material crack.

In general, all or a portion of a crack or damaged joint may be excavated with a jackhammer to enlarge the area to be repaired to accept an expansion form deemed appropriate for the repair. All or the lower portion of the expansion form is made from a polymeric closed cell foam material, such as polyethylene foam, that is sufficiently soft to be carved with hand tools at the repair site. A range of hand tools can be used to carve the bottom of the expansion form into the desired shape, such as scissors, razors, knives, saws, rasps, files, scrapers, sanders, and so forth. A technician carves the bottom of the expansion form at the repair site to approximately match the contour of the bottom of the spalled crack or joint, while the top of the expansion form is allowed to "run wild" above the surface grade level. A generous bead of flexible caulk is applied to the bottom of the crack or joint and the bottom of the joint is gently pressed into the caulk to create a seal between the bottom of the expansion form and the bottom of the crack or joint. The damaged area is then backfilled and graded to the surface level of the concrete deck. The grade of the backfill material to the surface level does not need to be precise and may, for example, slope slightly away from the expansion form to help drain water away from the expansion form. The backfill material abuts one or both lateral sides of the expansion form, or portions of one or both lateral sides of the expansion form, which allows the expansion form to expand and contract in response to expansion and contraction of the concrete slabs and the backfill material in order to mitigate cracking of the concrete slabs and the backfill material. The polymeric closed-cell foam of the expansion form typically has sawed lateral sides that opens the cells along the lateral sides of the expansion form to improve the adhesion between the expansion form and the backfill material. Lateral blocking supports may be used to support the expansion form upright and following the joint or crack while the damaged area is backfilled and allowed to set.

Once the backfill material has set adequately, typically about 2 hours, the portion of the expansion form extending above the surface level can be trimmed and the repair allowed to cure. Top trimming can alternatively be performed at a later time, such as the next day after the backfill material has fully cured. The portion of the expansion form extending above the surface level is typically trimmed close to the surface grade level and left exposed to the atmosphere. If desired, the expansion form can be trimmed slightly below the surface level to allow a sealing strip, such as a neoprene strip, to be adhered above the top of the expansion form. The repair can usually be completed during a single repair event and reopened to traffic the same day.

It should be appreciated that excavation may not be required for all repairs and may be included or eliminated as deemed appropriate. Similarly, carving the bottom of the expansion form may not be required for the full length of the repair and may be performed only where needed. In addition, caulking may not be required for the full length of the repair and may be performed only where needed. A variety of expansion forms are described below for use with concrete damage at joints, meandering cracks, 4-point (X-crossing) corner damage, and 3-point (T-crossing) corner damage.

Figure 1B:
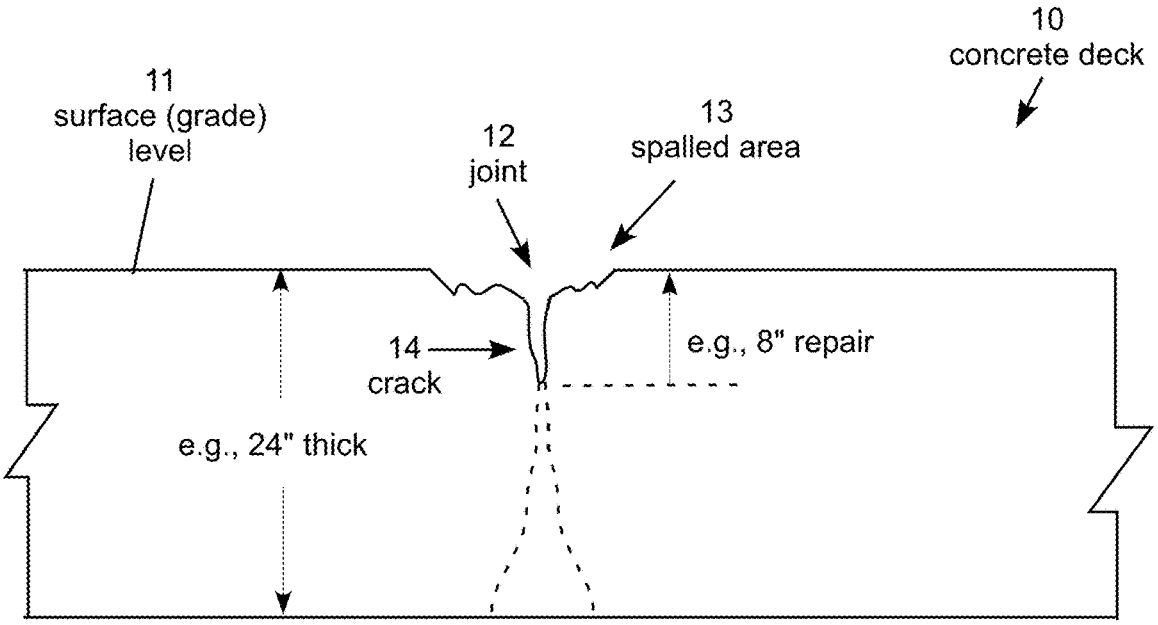
FIG. 1B is a sectional view of the spalled concrete damage of FIG. 1A.

FIG. 1A is a perspective view and FIG. 1B is a sectional view of spalled concrete damage in a representative concrete deck 10, which may but be, does not necessarily have to be, a relatively thick deck, such as a 24-inch thick concrete deck as may be found at airports, military bases, loading docks, concrete roadways, and the like. The concrete deck 10 has a surface level 11 and a damaged expansion or construction joint 12 (with a spalled area 13 on one or both sides of the joint 12. In different portions of the damaged area, the bottom of the damaged area may be formed by the joint 12 or a crack 14 extending below the joint. In some cases, the concrete damage, often involving hulling out, may extend further below the bottom of the joint 12 or crack 14 as indicated by the dashed lines in FIG. 1B. In some cases with heavily damaged concrete, the damaged area may be filled with gravel, piece of foam block, or other fill materials to within 4-inches to 8-inches of the surface level before the top 4-inches to 8-inches is repaired with an expansion form and backfill material abutting one or both lateral sides of the expansion form as described below.

Figure 2A:
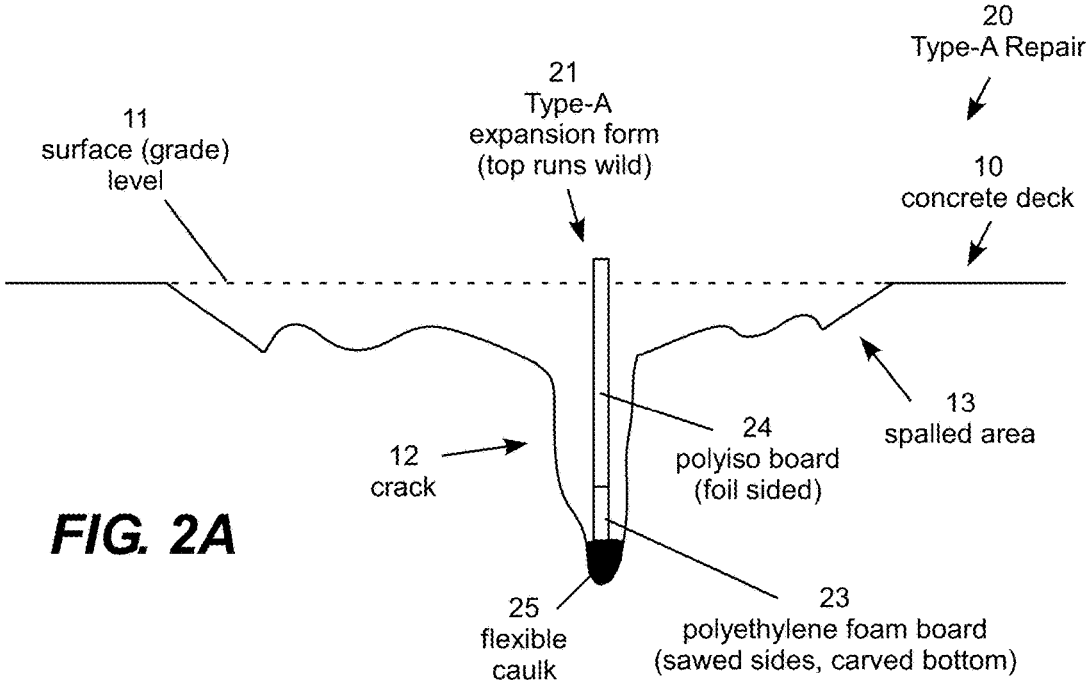
FIG. 2A is a sectional view of a partial repair of the concrete damage of FIG. 1A.

FIG. 2A is a sectional view of a partial Type-A repair 20 of the damaged linear joint 12 shown in FIGS. 1A-1B. FIG.

Figure 2B:
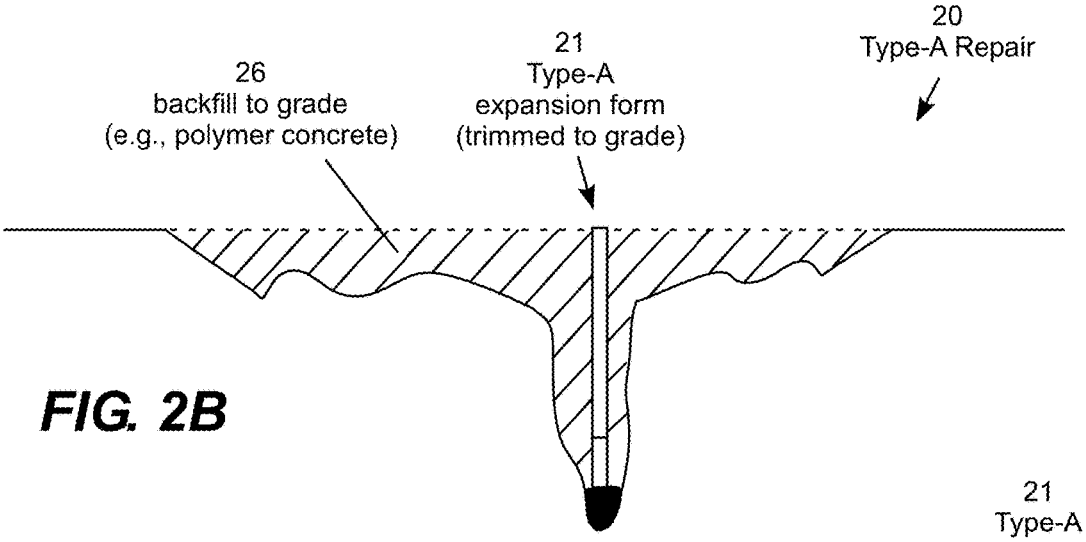
FIG. 2B is a sectional view of a completed repair of the concrete damage of FIG. 1A.
Figure 2C:
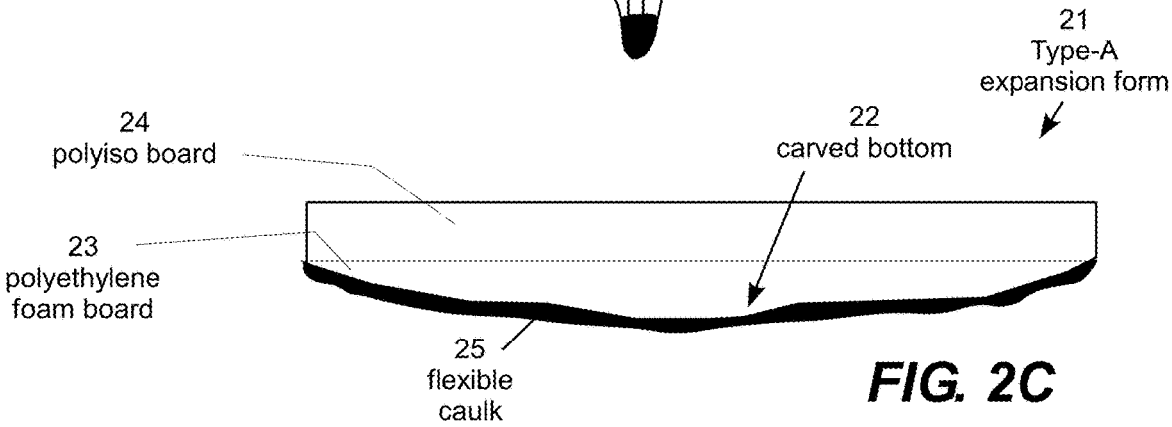
FIG. 2C is a lateral side view of a repair form utilized in the repair of the concrete damage of FIG. 1A.

2B is a sectional view of the completed repair and FIG. 2C is a lateral side view of a Type-A expansion form 21 utilized in the repair. In this example, sections or "blanks" of the Type-A expansion form 21 may be constructed prior to the concrete repair event. At the time of the concrete repair event, a technician creates a specific Type-A expansion form 21 for the repair by selecting a blank of an appropriate length and cutting one or both ends of the blank to obtain an expansion form of the desired length and end profiles. The Type-A expansion form 21 may include multiple sections, as deemed appropriate. Referring to FIG. 2C, the technician also carves at least a portion of the bottom of the Type-A expansion form 21 to create the carved bottom 22 to approximately match the contour of the bottom of the joint 12 or crack 14. An exact match of the contours is not required, but care should be taken to obtain a sufficiently close match between the shape of the bottom of the Type-A expansion form 21 and the bottom of the joint 12 or crack 14 so that a flexible caulk 25 can be used to create a seal between the bottom of the expansion form and the bottom of the joint or crack. At this point, the top of the Type-A expansion form 21 should extend above the surface (grade) level 11, but need not be trimmed to closely match the top of the expansion form to the grade level. The repair is easier to complete if the top of the expansion form 21 is allowed to "run wild" above the surface level, without having to closely match the surface level, prior to backfilling. The top of the expansion form 21 can be readily trimmed to the grade level after the concrete damage has been backfilled and the backfill material has been allowed to set or fully cure.

The Type-A expansion form 21 includes a closed-cell polymeric foam board lower section 23 adhered to a stiffer upper section 24. In this example, the lower section 23 is a polyethylene foam board with sawed sides and a carved bottom 22 approximately conforming to the shape of the bottom of the joint 12 or crack 14. The upper section 24 is a polyisocyanurate (polyiso) board, which is a closed-cell, rigid foam board with facers, such as foil, bonded on both lateral sides. Contact cement or another suitable adhesive is used to adhere the lower section 23 to the upper section 24. The polyethylene foam lower section 23 is softer than the polyiso board upper section 24 and therefore easier to shape to create the carved bottom 22, while the polyiso board is sufficiently rigid to remain straight and avoid flopping over while the damaged area is backfilled. The Type-A expansion form 21 is typically in the range of ½-inch to 2-inches thick, although other thickness may be used as appropriate for a particular joint to be repaired.

Once the Type-A expansion form 21 has been cut to the desired length and the bottom has been carved to have the desired profile, the technician applies a generous bead of flexible caulk 25 to seal the bottom of the joint 12 or crack 14. The technician then gently presses the bottom of the expansion form 21 into the flexible caulk 25 to create a seal between the carved bottom 22 of the expansion form and the bottom of the joint 12 or crack 14. The technician then backfills the damaged area with a backfill material 26, grades the backfill material to the surface level 11, and allows the backfill material to set. Although top trimming can be performed later, the top of the expansion form 21 extending above the surface level 11 can be trimmed after the backfill material 26 sets sufficiently, which is typically about two hours. The backfill material 26 is allowed to sufficiently cure before allowing traffic to return to the repaired area. The entire repair can usually be completed during a single repair event.

Figure 3A:
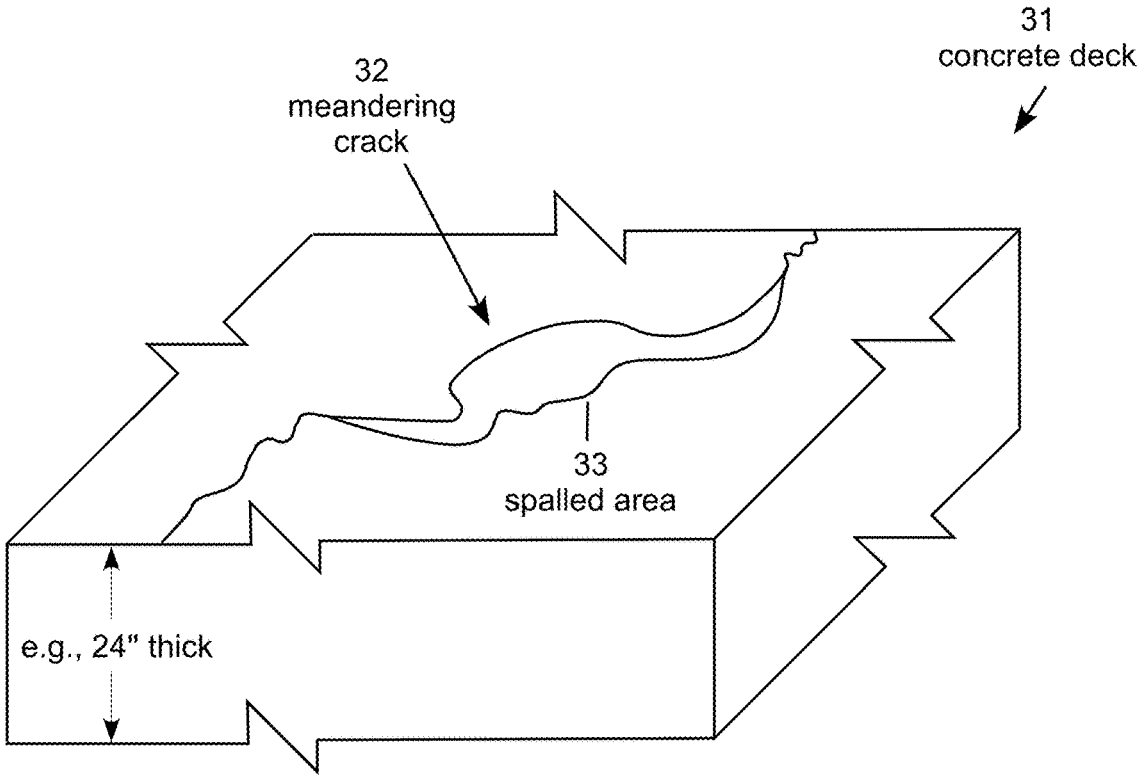
FIG. 3A is a perspective view of spalled concrete damage at meandering crack in a representative concrete deck.
Figure 3B:
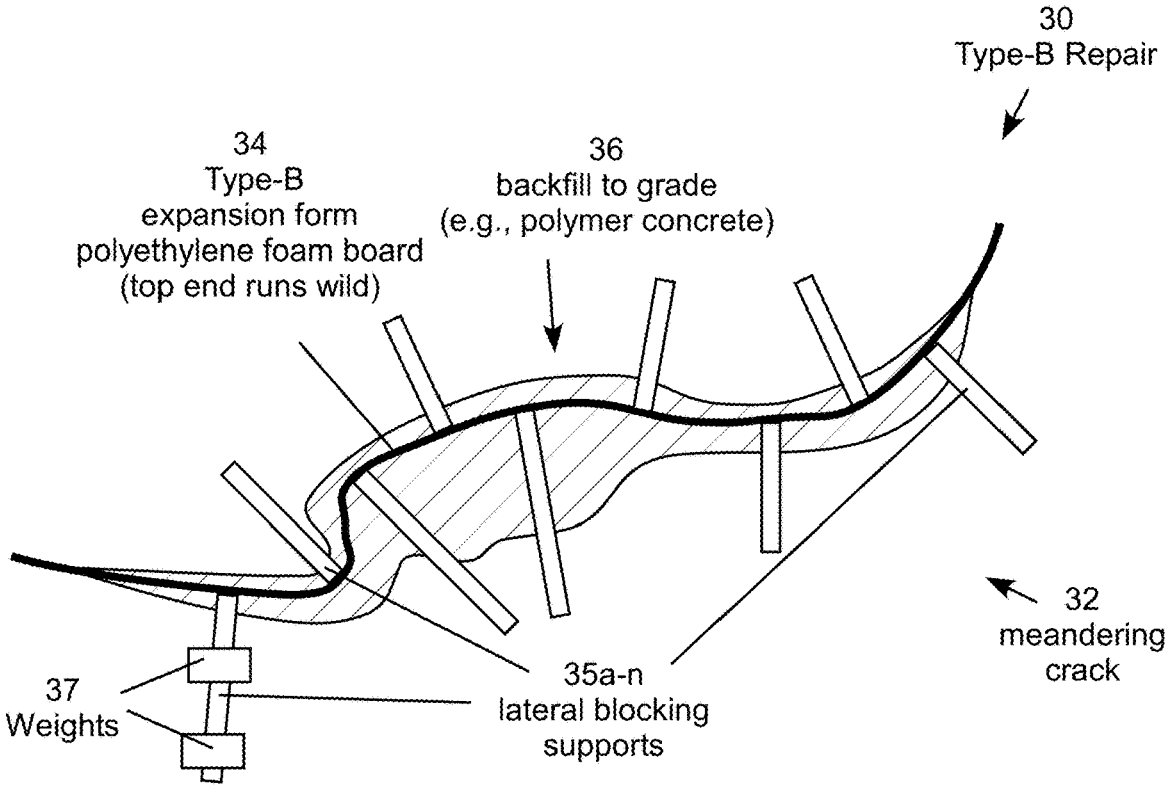
FIG. 3B is a top view of a repair of the concrete damage of FIG. 3A.

FIG. 3A is a perspective view of a representative concrete deck 31 that has a meandering crack 32 including spalled concrete damage 33. FIG. 3B is a top view of a Type-B repair 30 of the concrete damage. A flexible Type-B expansion form 34 is shaped and placed into the meandering crack 32. The Type-B expansion form 34 meanders within the spalled area 33 where it is supported in an upright position and following the joint or crack by lateral blocking supports **35*a-n*, such as 2-by-4 pieces of lumber. The lateral blocking supports 35*a-n* are typically held in place by weights 37, such as construction blocks, as shown for the representative lateral blocking support 35*a*. The lateral blocking supports 35*a-n* are temporarily installed while the crack 32 and the spalled area 33 are backfilled with a backfill material 36, such as polymer concrete, and graded to the surface level of the concrete deck 31. Once the backfill material 36 has set or fully cured, the lateral blocking supports 35*a-n*** are removed.

Figure 3C:
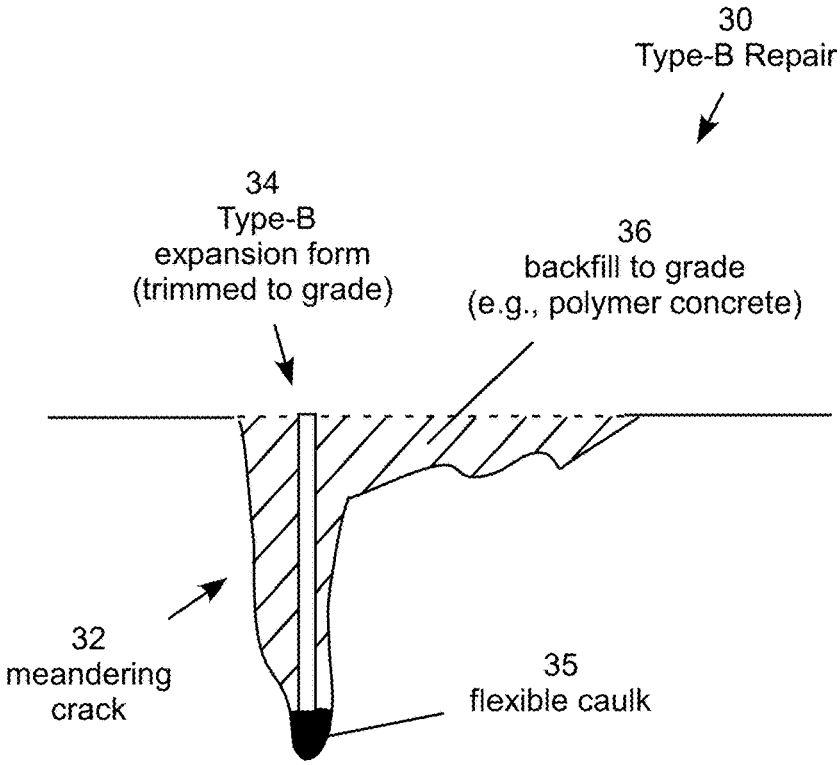
FIG. 3C is a sectional view of the repair of a non-excavated portion of the concrete damage of FIG. 3A.
Figure 3D:
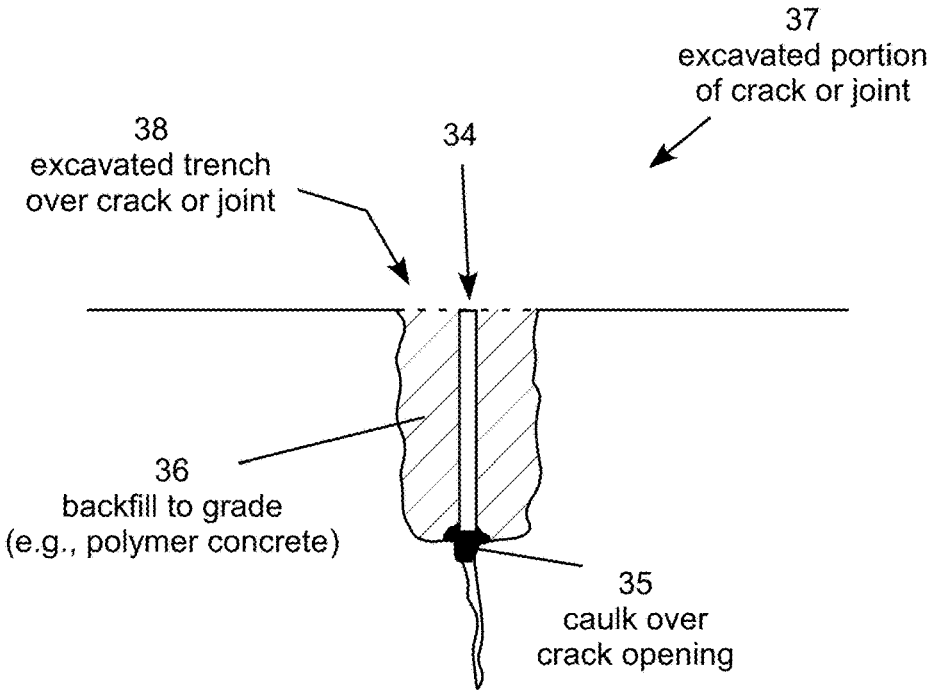
FIG. 3D is a sectional view of the repair of an excavated portion of the concrete damage of FIG. 3A.

FIG. 3C is a sectional view of the Type-B repair 30 and FIG. 3D is a sectional view of an excavated portion 37 of the repair. The Type-B expansion form 34 is typically a closed-cell foam strip, such as polyethylene foam, 4-inches to 8-inches tall. The foam strip is typically cut from a foam block so that it has sawed sides. All or a portion of the bottom of the foam strip is carved to approximately match the contour of the bottom of the crack 32. The repair is easier to complete if the top of the expansion form 34 is allowed to run wild above the surface level prior to backfilling. The top of the Type-B expansion form 34 can be readily trimmed to the surface level any time after the backfill material has sufficiently set, which is typically about two hours.

Portions of the meandering crack 32 may be excavated with a jackhammer to make the crack large enough to receive the flexible Type-B expansion form 34. For example, portions of meandering crack 32 extending beyond ends of the spalled area 33 may be excavated to allow the Type-B expansion form 34 to extend beyond the spalled area 33. In this example, the portions of meandering crack 32 extending beyond ends of the spalled area 33 may be excavated to create channels about 6-inches to a foot long, 4-inches to 8-inches deep, and 4-inches to 6-inches wide to accommodate the Type-B expansion form 34 and backfill material The Type-B expansion form 34 is typically in the range of ½-inch to 2-inches thick, although other thickness may be used as appropriate for a particular joint to be repaired. Jackhammered excavations are usually performed for meandering cracks but may also be used for joint repair, and may be performed for repairs utilizing any type of expansion or joint forms, as deemed appropriate.

Once the Type-B expansion form 34 has been cut to length and carved to have the desired bottom shape, the technician applies a generous bead of flexible caulk 35 to seal the bottom of the meandering crack 32. The technician then gently presses the bottom of the expansion form 34 into the flexible caulk 35 to create a seal between the bottom of the expansion form and the bottom of the meandering crack 32. The technician then backfills the damaged area with a backfill material 36, grades the backfill material to the surface level 11, and allows the backfill material to set. The lateral blocking supports **35*a-n* are removed and top of the expansion form 34 extending above the surface level is trimmed to grade any time after the backfill material 36 has set sufficiently, typically about two hours. The backfill material 36** is allowed to sufficiently cure before allowing traffic to return to the repaired area. The entire repair can usually be completed during a single repair event.

Figure 4A:
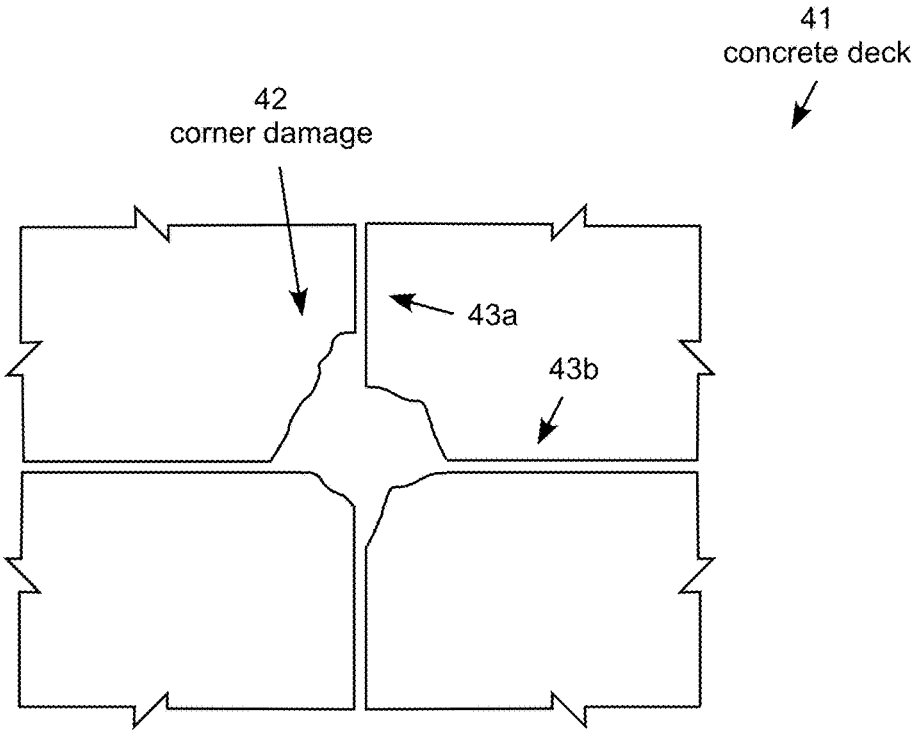
FIG. 4A is a top view of corner damage at crossing joints in a representative concrete deck.
Figure 4B:
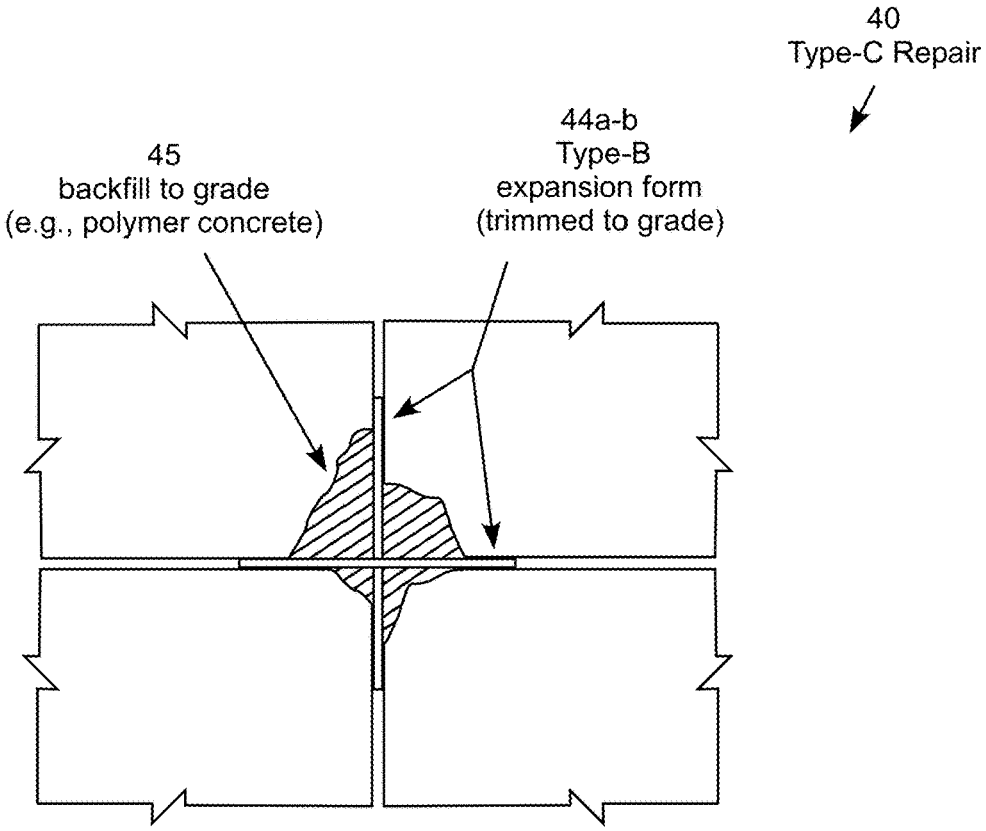
FIG. 4B is a top view of a repair of the concrete damage of FIG. 4A.
Figure 4C:
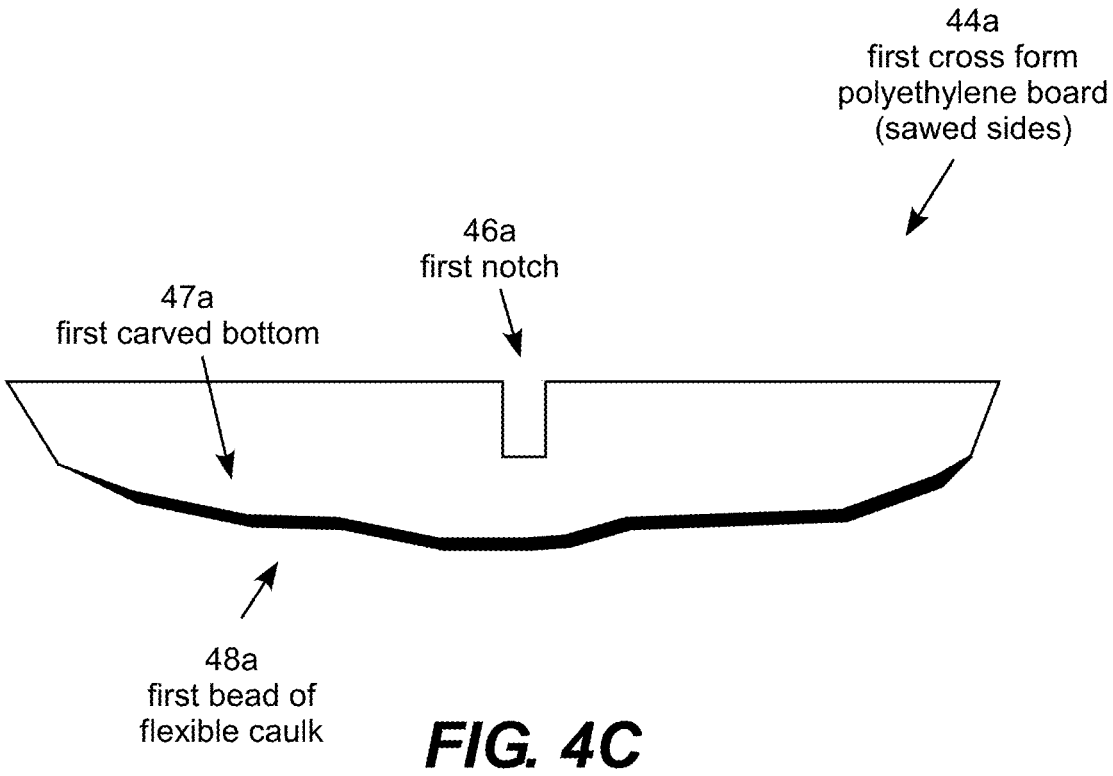
FIG. 4C is a lateral side view of a first cross-form utilized in the repair of the concrete damage of FIG. 4A.
Figure 4D:
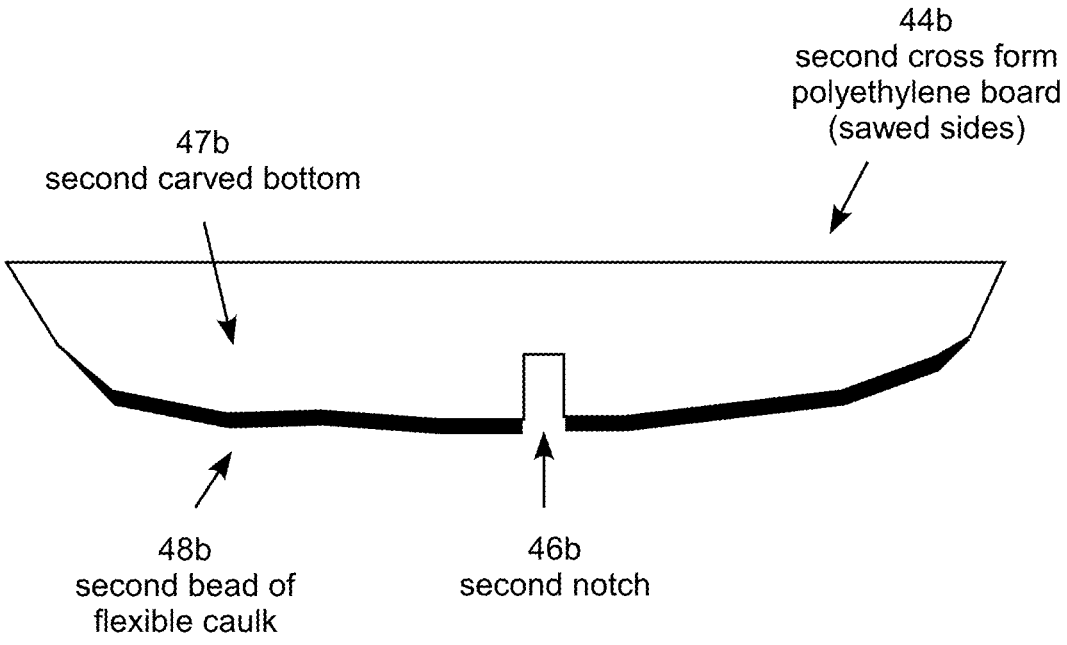
FIG. 4D is a lateral side view of a second cross-form utilized in the repair of the concrete damage of FIG. 4A.

FIG. 4A is a top view of a representative concrete deck 41 with 4-corner (X-crossing) damage 42 at crossing expansion or construction joints 43*a* and 43*b*. FIG. 4B is a top view of a Type-C repair 40 of the concrete damage of FIG. 4A. The techniques described above, the cross forms 44*a* and 44*b*, and the backfill material 45 are utilized to repair the corner damage. FIG. 4C is a lateral side view of the first cross form 44*a*, which includes a first notch 46*a* in the top edge of the first cross form, and FIG. 4D is a lateral side view of the second cross form 44*b*, which includes a second notch 46*b* in the bottom edge of the second cross form. The notches 44*a* and 44*b* interlock to support the cross forms 44*a* and 44*b* in the crossing joints 43*a* and 43*b*. All or a portion of the bottom of the first cross form 44*a* is typically carved to create a first carved bottom 47*a* to approximately conform the shape of the bottom of the first expansion form to the bottom of the first joint 43*a*. Similarly, all or a portion of the bottom of the second cross form 44*b* is typically carved to create a second carved bottom 47*b* to approximately conform the shape of the bottom of the second expansion form to the bottom of the second joint 43*b*. A first bead of flexible caulk 48*a* may be applied to create a seal between the bottom of the first carved bottom 47*a* of the first expansion form 44*a* and the bottom of the first joint 43*a*. Similarly, a second bead of flexible caulk 48*b* may be applied to create a seal between the bottom of the second carved bottom 47*b* of the second expansion form 44*b* and the bottom of the second joint 43*b*. The joints 43*a* and 43*b* may be excavated and lateral blocking support may be used as deemed appropriate. The cross forms 44*a* and 44*b* may be made from closed-cell foam, such a polyethylene foam block with sawed sides, with or without upper stiffener boards, such as foil-sided polyiso boards, as deemed appropriate. The cross forms 44*a* and 44*b* are typically in the range of ½-inch to 2-inches thick, although other thickness may be used as appropriate for a particular joint to be repaired.

Figure 5A:
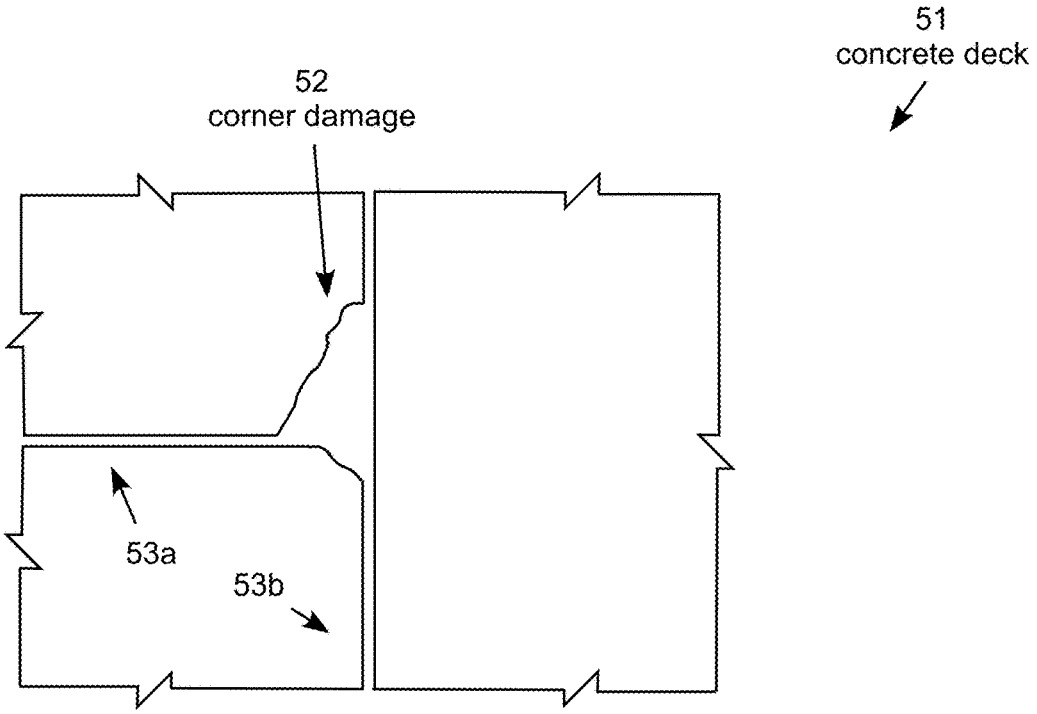
FIG. 5A is a top view of corner damage at T-crossing joints in a representative concrete deck.
Figure 5B:
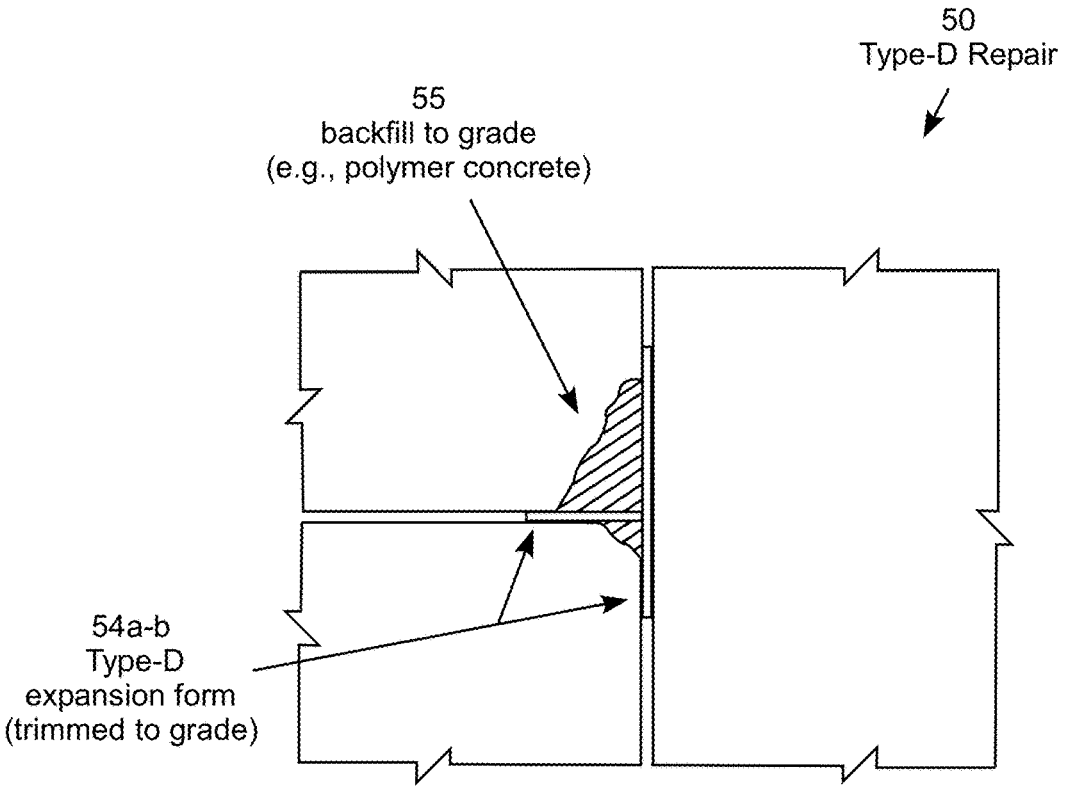
FIG. 5B is a top view of a repair of the concrete damage of FIG. 5A.

FIG. 5A is a top view of a representative concrete deck 51 with 3-corner (T-crossing) damage 52 at crossing joints 53*a* and 53*b*. FIG. 5B is a top view of a Type-D repair 50 of the concrete damage of FIG. 5A. The techniques described above, the expansion forms 54*a* and 54*b*, and the backfill material 55 are utilized to repair the corner damage. The first expansion form 54*a* may have a first carved bottom to approximately conform the shape of the bottom of the first expansion form to the bottom of the first joint 53*a*. Similarly, the second expansion form 54*b* may have a second carved bottom to approximately conform the shape of the bottom of the second expansion form to the bottom of the second joint 53*b*. A first bead of flexible caulk may be applied to create a seal between the bottom of the first carved bottom of the first expansion form 54*a* and the bottom of the first joint 53*a*. Similarly, a second bead of flexible caulk may be applied to create a seal between the bottom of the second carved bottom of the second expansion form 54*b* and the bottom of the second joint 53*b*. The joints 53*a* and 53*b* may be excavated and lateral blocking support may be used as deemed appropriate. The expansion forms 54*a* and 54*b* may be made from closed-cell foam, such a polyethylene foam block with sawed sides, with or without upper stiffener boards, such as foil-sided polyiso boards, as deemed appropriate. The cross forms 54*a* and 44*b* are typically in the range of ½-inch to 2-inches thick, although other thickness may be used as appropriate for a particular joint to be repaired.

Figure 6:
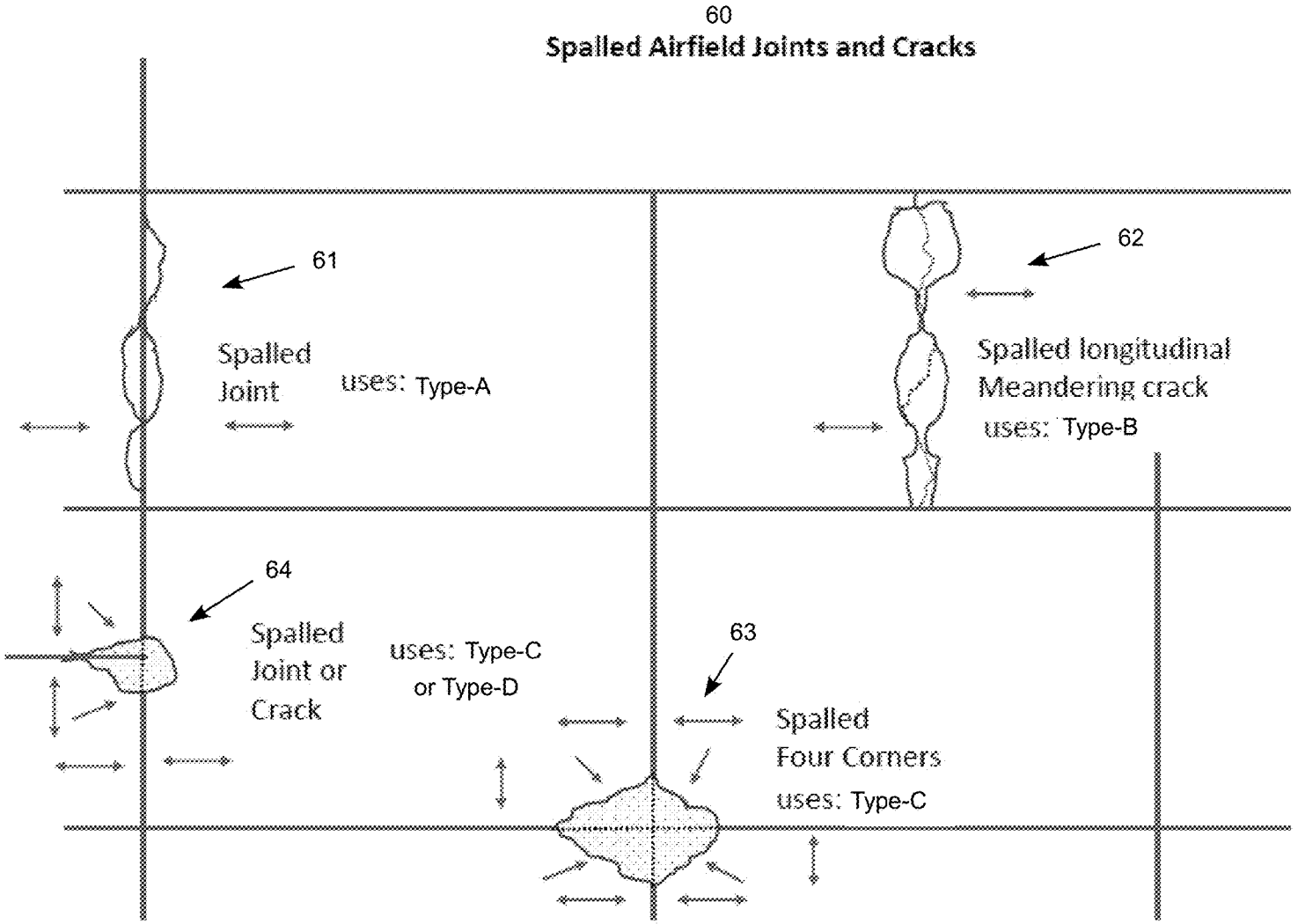
FIG. 6 is a diagram illustrating top views of different types of concrete damage and associated repair types.

FIG. 6 is a diagram 60 illustrating different types of concrete damage and associated repair types. Concrete damage 61 includes spalled damage along an expansion or construction joint (e.g., FIGS. 1A-1C). A Type-A repair (e.g., FIGS. 2A-2C) is typically suitable for this type of damage. Concrete damage 62 includes spalled damage along a meandering crack (e.g., FIG. 3A). A Type-B repair is typically suitable for this type of damage (e.g., FIGS. 3B-3D). Concrete damage 62 includes corner damage at a 4-point (X-crossing) corner (e.g., FIG. 4A). A Type-C repair is typically suitable for this type of damage (e.g., FIGS. 4B-4D). Concrete damage 63 includes corner damage at a 3-point (T-crossing) corner (e.g., FIG. 5A). A Type-C repair is typically suitable for this type of damage (e.g., FIG. 5B).

Figure 7:
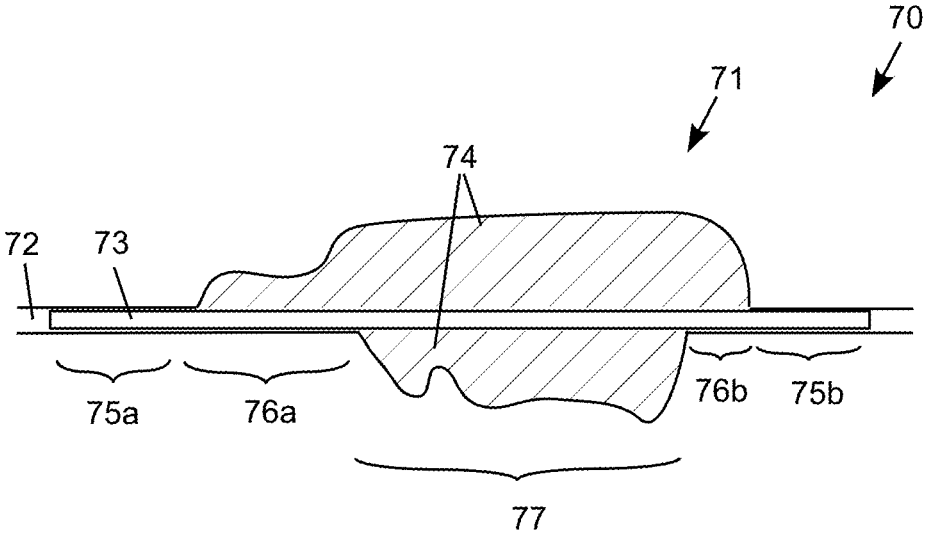
FIG. 7 is a diagram illustrating a top view of an illustrative concrete repair.

FIG. 7 is a diagram illustrating a top view of an illustrative concrete repair 70, which may be applicable to any of the previously described repair types. In this example, the repair 70 had been completed to spalled damage 71 along a lateral joint or meandering crack represented by the opening 72. The spalled damage 71 has been repaired with an expansion form 73 and a backfill material 74. The lateral joint or meandering crack is sufficiently wide, or has been excavated to be sufficiently wide, on both sides of the spalled area 71, to accept the expansion form 73 extending beyond both sides of the spalled area. The expansion form 73 has opposing lateral (upright) sides extending laterally through the spalled damage 71, which allows the expansion form to expand and contract to minimize cracking of the concrete slabs and the backfill material 74. The expansion form 73 is somewhat longer than the spalled area 71 allowing the expansion form to extend about 6-inches to a foot into un-spalled portions 75*a-b* of the opening 72 on both sides of the spalled area 71. In the un-spalled portions 75*a-b* of the opening 72, the expansion form 73 abuts the concrete nosings of the joint or crack (which may be excavated) and therefore has no backfill material abutting either lateral side of the expansion form. Along other portions 76*a-b*, the expansion form 73 abuts one concrete nosing on one lateral side, and abuts the backfill material 74 on the other lateral side of the expansion form. And along another portion 77, the expansion form 73 abuts the backfill material 74 on both sides of the expansion form. This helps to support the expansion form 73 in an upright and following the joint or crack while the backfill material 74 is placed into the spalled area 71 and allowed to set. Additional lateral blocking supports may also be used, as deemed appropriate, to provide additional support to maintain the expansion form 73 upright while the backfill material 74 is applied into the spalled damage 71 and allowed to set.

Figure 8:
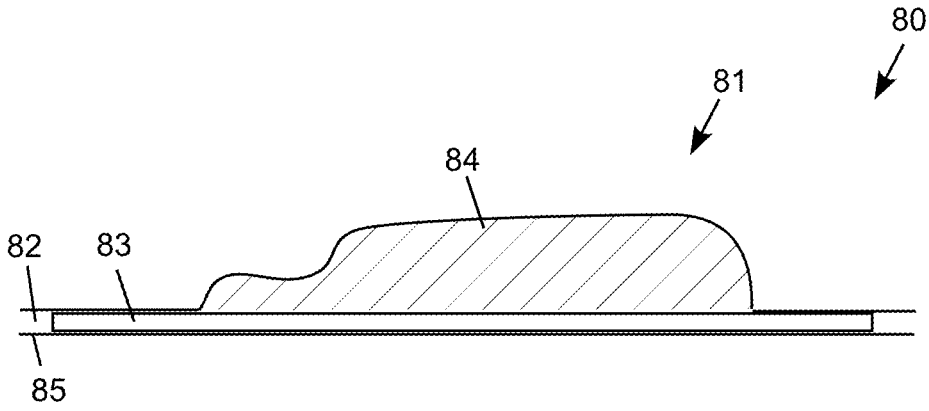
FIG. 8 is a diagram illustrating a top view of another illustrative concrete repair.

FIG. 8 is a diagram illustrating a top view of another illustrative concrete repair 80, which is well suited to Type-A repairs where only one of the concrete slabs has experienced damage, but may be applicable to other repair types. In this example, the repair 80 had been completed to spalled damage 81 along a lateral joint or meandering crack represented by the opening 82. The spalled damage 81 has been repaired with an expansion form 83 and a backfill material 84. The lateral joint or meandering crack is sufficiently wide, or has been excavated to be sufficiently wide, on one sides of the spalled area 81 to accept the expansion form 83 extending beyond both sides of the spalled area. The expansion form 83 has opposing lateral (upright) sides extending laterally through the spalled damage 81, which allows the expansion form to expand and contract to minimize cracking of the concrete slabs and the backfill material 84. In this example, the spalled damage 81 occurs on only one side of the opening 82. The backfill material 84 therefore abuts only one lateral side of the expansion form 83, which abuts the nosing 85 of one of the concrete slab on the other lateral side.

While particular aspects of the present subject matter have been shown and described in detail, it will be apparent to those skilled in the art that, based upon the teachings of this disclosure, changes and modifications may be made without departing from the subject matter described in this disclosure and its broader aspects and, therefore, the appended claims are to encompass within their scope all such changes and modifications as are within the true spirit and scope of the subject matter described in this disclosure. Although particular embodiments of this disclosure have been illustrated, it is apparent that various modifications and embodiments of the disclosure may be made by those skilled in the art without departing from the scope and spirit of the disclosure.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. The disclosure is defined by the following claims, which should be construed to encompass one or more structures or function of one or more of the illustrative embodiments described above, equivalents and obvious variations. It will therefore be appreciated that the present invention provides significant improvements. The foregoing relates only to the exemplary embodiments of the present invention, and that numerous changes may be made therein without departing from the spirit and scope of the invention as defined by the following claims.

The invention claimed is:

1. A method for repairing concrete damage in a concrete deck having a surface level, the damage comprising a joint or crack extending across a spalled area, comprising the steps of:

creating an expansion form comprising a polymeric closed cell foam having a length sufficient to follow the joint or crack across the spalled area and a height greater than a depth of the spalled area;

carving a bottom side of the expansion form to approximately match a contour of a bottom of the crack or joint across the spalled area;

applying a bead of flexible caulk to the bottom of the crack or joint;

pressing the bottom side of the expansion form into the flexible caulk to create a seal between the bottom side of the expansion form and the bottom of the crack or joint while allowing a top side of the expansion form to run wild above the surface level;

backfilling the spalled area with a backfill material abutting the expansion form;

grading the backfill material to the surface level;

allowing the backfill material to set;

trimming the top side of the expansion form extending above the surface level.

2. The method of claim 1, wherein the expansion form comprises a polyethylene foam board.

3. The method of claim 1, wherein the expansion form comprises a polyethylene foam board with sawed lateral sides creating open cells along the lateral sides to facilitate adhesion of the expansion form to the backfill material.

4. The method of claim 1, wherein the expansion form comprises a polymeric closed cell foam board bottom portion adhered to a polyiso board upper portion.

5. The method of claim 1, further comprising, positioning lateral blocking supports against the expansion form while backfilling the spalled area;

removing the lateral blocking supports after the backfill material has set.

6. The method of claim 1, wherein a portion of the joint or crack extends beyond the spalled area, further comprising extending the expansion form into the portion of the joint or crack that extends beyond the spalled area.

7. The method of claim 1, wherein two portions of the joint or crack extend beyond the spalled area, further comprising extending the expansion form into both portions of the joint or crack that extend beyond the spalled area.

8. The method of claim 1, wherein a portion of the joint or crack extends beyond the spalled area, further comprising:

excavating the portion of the joint or crack that extends beyond the spalled area;

extending the expansion form into the excavated portion of the joint or crack that extends beyond the spalled area.

9. The method of claim 1, wherein two portions of the joint or crack extend beyond the spalled area, further comprising:

excavating both portions of the joint or crack that extends beyond the spalled area;

extending the expansion form into both excavated portions of the joint or crack that extend beyond the spalled area.

10. The method of claim 1, further comprising positioning a lateral side of the expansion form against a concrete nosing and backfilling the spalled area abutting an opposing lateral side of the expansion form.

11. The method of claim 1, wherein the concrete damage involves a 4-point corner defined by two X-crossing joints, the joint or crack comprises a first joint of the X-crossing joints, and the expansion form is a first expansion form, further comprising:

cutting an upper notch into the top side of the first expansion form;

creating a second expansion form;

cutting a lower notch into a bottom side of the second expansion form;

placing the second expansion form into a second joint of the X-crossing joints with the lower notch interlocking with the upper notch.

12. The method of claim 11, further comprising:

carving a bottom side of the second expansion form to approximately match a contour of a bottom of the second joint;

applying a bead of flexible caulk to the bottom of the second joint;

pressing the bottom side of the second expansion form into the flexible caulk at the bottom of the second joint to create a seal between the bottom side of the second expansion form and the bottom of the second joint while allowing a top side of the second expansion form to run wild above the surface level;

backfilling the spalled area abutting the second expansion form;

grading the backfill material abutting the second expansion form to the surface level;

allowing the backfill material abutting the second expansion form to set;

trimming the top side of the second expansion form extending above the surface level.

13. The method of claim 1, wherein the concrete damage involves a 3-point corner defined by two T-crossing joints, the joint or crack comprises a first joint of the T-crossing joints, and the expansion form is a first expansion form, further comprising:

creating a creating a second expansion form;

placing the second expansion form into a second joint of the T-crossing joints with an end portion of the second expansion form abutting a portion of the first expansion form.

14. The method of claim 13, further comprising:

carving a bottom side of the second expansion form to approximately match a contour of a bottom of the second joint;

applying a bead of flexible caulk to the bottom of the second joint;

pressing the bottom side of the second expansion form into the flexible caulk at the bottom of the second joint to create a seal between the bottom side of the second expansion form and the bottom of the second joint while allowing a top side of the second expansion form to run wild above the surface level;

backfilling the spalled area abutting the second expansion form;

grading the backfill material abutting the second expansion form to the surface level;

allowing the backfill material abutting the second expansion form to set;

trimming the top side of the second expansion form extending above the surface level.

* * * * *